US005479240A

United States Patent [19]

Lee et al.

[11] Patent Number: 5,479,240

[45] Date of Patent: Dec. 26, 1995

[54] METHOD FOR CONTROLLING AUTOMATIC DISCHARGE OF JAMMED PAPER FOR AUTOMATIC JAM REMOVAL

[75] Inventors: Byoung B. Lee; Gil K. Youn; Han S. Oh, all of Seoul, Rep. of Korea

[73] Assignee: Sindo Ricoh Co., Ltd., Seoul, Rep. of Korea

[21] Appl. No.: 298,038

[22] Filed: Aug. 30, 1994

[30] Foreign Application Priority Data

Jun. 14, 1994 [KR] Rep. of Korea ..... 1994-13388

[51] Int. Cl.[6] ..... G03G 21/14

[52] U.S. Cl. ..... 355/207; 355/206; 355/313

[58] Field of Search ..... 355/207, 206, 355/205, 308, 309, 313; 271/3.1

[56] References Cited

U.S. PATENT DOCUMENTS

| | | | |
|---|---|---|---|
| 4,026,543 | 5/1977 | Leclere . | |
| 4,157,822 | 6/1979 | Miller | 271/3.1 |
| 4,213,190 | 7/1980 | Finlay et al. | 364/900 |
| 4,317,629 | 3/1982 | Kuseski . | |
| 4,421,404 | 12/1983 | Conly . | |
| 4,737,820 | 4/1988 | Murray . | |
| 4,878,087 | 10/1989 | Sakai et al. . | |
| 4,952,975 | 8/1990 | Ito et al. | 355/206 |
| 5,034,771 | 7/1991 | Makita . | |

*Primary Examiner*—R. L. Moses
*Attorney, Agent, or Firm*—Darby & Darby

[57] ABSTRACT

A method for controlling an automatic discharge of a paper jammed in a copy machine, capable of eliminating a requirement for a user to directly remove the jammed paper. The method provides provides three jam removal modes, that is, an automatic jam removal mode for performing automatic try for removal of jam, a semi-automatic jam removal mode for performing a try for removal of jam when the user presses down the copying start key, and a manual jam removal mode for stopping the copy machine upon generation of jam, as in existing copy machines, thereby preventing deterioration of driving parts of the copy machine such as abrasion of rollers caused by forced discharge of the jammed paper, enabling the user to directly remove without opening a door of the copy machine while minimizing contamination of development and fixture parts of the copy machine and damage of driving parts of the copy machine, and capable of displaying signs indicative of a jam removing state and a manual removal of jammed papers, thereby enabling the user to recognize the state of the copy machine, and thereby obtaining a convenience in use.

16 Claims, 15 Drawing Sheets

METHOD FOR CONTROLLING AUTOMATIC DISCHARGE OF JAMMED PAPER FOR AUTOMATIC JAM REMOVAL

BACKGROUND OF THE INVENTION

1. Field of the Invention

The present invention relates to a method for removing a jam generated in a copy machine, a PPF (plain paper facsimile), an LBP (laser beam printer) (hereinafter, simply referred to as "copy machine"), and more particularly to a method for controlling an automatic discharge of a paper jammed in a copy machine, capable of eliminating a requirement for a user to directly remove the jammed paper.

2. Description of the Prior Art

In a copy machine, jamming of copy papers occurs frequently on its path from a paper supply position to a paper discharge position due to the condition of the papers, the condition of the machine and the surrounding circumstance. Once such a jam occurs the user recognizes the position where the jam has occurred by viewing a jam sign and a jam position sign both displayed on the manipulation panel and then opens the cover of copy machine to remove the jammed paper. After complete removal of the jammed paper, the copy machine can be normally operated.

When a jam is generated in the conventional case, the user should remove the jammed paper directly, as mentioned above. During the removal of the jammed paper, the user's hand may get dirty by toner. In some cases, it is very difficult to remove the jammed paper. Furthermore, the process of removing the jammed paper requires much time because it involves opening of the cover, removal of the jammed paper and resetting of moved elements.

For solving the above-mentioned problems, the applicant has proposed an improved method for removing a jam of copy papers in the Korean Patent Application No. 93-5455. However, this method involves the following problems.

First, when the jam is generated upon switching off a power supply source or when the power supply source is switched off under a condition that the jam has been generated, this method proposes a scheme of discharging a jammed paper by a forced discharge obtained upon switching on the power supply source after long time has passed since the power supply source was switched off. However, this method involves a problem that a development unit of the copy machine is not accompanied, so that the drum and the jammed paper get stained with a large amount of toner. This increases contamination generated at elements of the copy machine. Since the jammed paper being forcedly discharged passes through a fixture unit at a temperature not more than a fixture enabling temperature. This results in severe contamination of a fixture roller.

Second, the method proposes a scheme of calculating a drive time of driving parts of the copy machine by dividing the distance between the paper supply position and the paper discharge position by a drive velocity and driving the driving parts of the copy machine on the basis of the calculated result. In a case of a jam that can not be removed only by driving the driving parts of the copy machine, however, there is a possibility that the jam rather becomes severe due to the driving for long time involved. There is also a problem of abrasion of rollers and damage of other driving elements due to the over-driving of the driving parts.

Third, since a main motor of the copy machine is automatically driven for forcedly discharging the jammed paper without displaying any sign on the manipulation panel, the user may get confused at the sudden movement of the driving parts.

Fourth, since the copy machine is always set at an automatic discharge state in accordance with the method, it tries continuously the forced paper discharge even when a jam is caused by a problem on the driving parts. This results in damage of the driving parts.

SUMMARY OF THE INVENTION

Therefore, an object of the invention is to solve the above-mentioned problems encountered in the prior art and, thus, to provide a method for controlling an automatic discharge of jammed papers in a copy machine, enabling the user to directly remove without opening a door of the copy machine while minimizing contamination of development and fixture parts of the copy machine and damage of driving parts of the copy machine, and capable of displaying signs indicative of a jam removing state and a manual removal of jammed papers, thereby enabling the user to recognize the state of the copy machine, and thereby obtaining a convenience in use.

In accordance with one aspect, the present invention provides a method for controlling an automatic discharge of a jammed paper to automatically remove a jam generated in a machine including a plurality of sensing means adapted to sense various operation conditions of the machine, central processing means adapted to analyze output signals from the sensing means and control overall operation of the machine on the basis of the analysis, means for supplying a power to various parts of the machine under a control of the central processing means, means for driving various parts of the machine under a control of the central processing means, and a manipulation panel coupled to the central processing means, the method comprising the steps of: (A) discriminating a jam removal mode currently set when the jam is generated; (B) checking kind of the generated jam where the current jam removal mode corresponds to an automatic or semi-automatic mode, incrementing, by one, a jam count indicative of the number of repeated jam removal operations in the current jam removal mode, determining whether the incremented jam count has reached a predetermined maximum jam removal number, manually removing the jam when the incremented jam count has reached the predetermined maximum jam removal number, while setting a jam removal try requiring flag and displaying the jam when the incremented jam count has not reached the predetermined maximum jam removal number; (C) displaying a position of the jam, powering off a main driving part of the machine, and powering off predetermined parts of the machine for avoiding a generation of fire and a user from getting burnt upon manually removing the jam; (D) checking whether the jam removal try requiring flag has been set, and checking kind of the jam when the jam removal try requiring flag has been set; (E) checking whether a temperature of a fixture roller equipped in the machine has reached a fixture enable temperature where the jam generated corresponds to a body jam, determining whether the jam removal operation is to proceed, performing the jam removal operation on the basis of the just above determination, while proceeding to a subsequent step without performing any jam removal operation where the jam corresponds to a miss feed jam at a paper supply part of the machine to perform a copying operation; (F) checking whether the jam removal mode set corresponds to the automatic removal mode or the semi-automatic removal mode, immediately performing the copying operation where the set jam removal mode corresponds to the automatic removal mode, while keeping a copying standby state and performing the copying operation when the user presses down a copying start key where the set jam removal mode corresponds to the semi-automatic removal mode; (G) checking whether a jam has been generated after completion of the copying operation at the step (F), repeatedly executing all the above steps where the jam has been generated, while clearing associated counters and flags when a normal paper discharge has been accomplished, checking a copying mode currently set, repeatedly executing the copying operation performing step of the step (F) and the steps following the copying operation performing step where the set copying mode corresponds to a continuous copying mode, while repeatedly executing the copying standby step of the step (F) and the steps following the copying standby step where the set copying mode does not correspond to the continuous copying mode.

In accordance with another aspect, the present invention provides a method for controlling an automatic discharge of a jammed paper to automatically remove a jam generated in a machine including a plurality of sensing means adapted to sense various operation conditions of the machine, central processing means adapted to analyze output signals from the sensing means and control overall operation of the machine on the basis of the analysis, means for supplying a power to various parts of the machine under a control of the central processing means, means for driving various parts of the machine under a control of the central processing means, a manipulation panel coupled to the central processing means, and sorter control means coupled to the central processing means, the method comprising the steps of: (A) discriminating a jam removal mode currently set when the jam is generated; (B) checking kind of the generated jam where the current jam removal mode corresponds to an automatic or semi-automatic mode, incrementing, by one, a jam count indicative of the number of repeated jam removal operations in the current jam removal mode, determining whether the incremented jam count has reached a predetermined maximum jam removal number, manually removing the jam when the incremented jam count has reached the predetermined maximum jam removal number, while setting a jam removal try requiring flag and displaying the jam when the incremented jam count has not reached the predetermined maximum jam removal number; (C) displaying a position of the jam, powering off a main driving part of the machine, and powering off predetermined parts of the machine for avoiding a generation of fire and a user from getting burnt upon manually removing the jam; (D) checking whether the jam removal try requiring flag has been set, and checking kind of the jam when the jam removal try requiring flag has been set; (E) checking whether the jam generated corresponds to a miss feed jam at a paper supply part of the machine or a body jam, checking whether a temperature of a fixture roller equipped in the machine has reached a fixture enable temperature where the generated jam corresponds to the body jam, checking a jam removal mode currently set, checking whether a sorter equipped in the machine is at its opened state, and then performing a forced jam removal operation, while proceeding to a subsequent step without performing any jam removal operation where the jam corresponds to the miss feed jam to perform a copying operation; (F) checking whether the jam removal mode set corresponds to the automatic removal mode or the semi-automatic removal mode, immediately performing the copying operation where the set jam removal mode corresponds to the automatic removal mode, while keeping a copying standby state and performing the copying operation when the user presses down a copying start key where the set jam removal mode corresponds to the semi-automatic removal mode; (G) checking whether a jam has been generated after completion of the copying operation at the step (F), repeatedly executing all the above steps where the jam has been generated, while clearing associated counters and flags when a normal paper discharge has been accomplished, checking a copying mode currently set, repeatedly executing the copying operation performing step of the step (F) and the steps following the copying operation performing step where the set copying mode corresponds to a continuous copying mode, while repeatedly executing the copying standby step of the step (F) and the steps following the copying standby step where the set copying mode does not correspond to the continuous copying mode.

BRIEF DESCRIPTION OF THE DRAWINGS

Other objects and aspects of the invention will become apparent from the following description of embodiments with reference to the accompanying drawings in which.

DETAILED DESCRIPTION OF THE PREFERRED EMBODIMENTS

Figure 1:
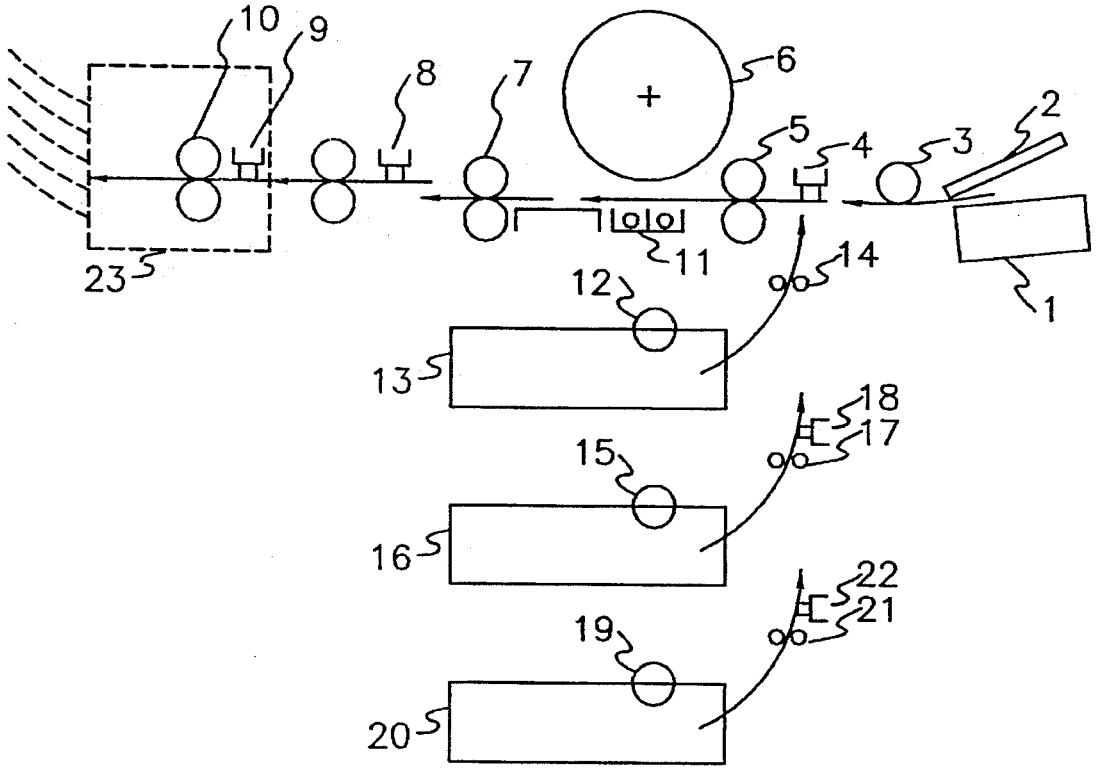
FIG. 1 is a schematic view illustrating a paper feeding path defined in a copy machine.

FIG. 1 is a schematic view illustrating a paper feeding path defined in a copy machine. In FIG. 1, the reference numeral 1 denotes a side paper cassette, 2 a manual paper supply table 2, 3 a side paper supply pickup roller, 4 a resist sensor, 6 a drum, 7 a fixture roller, 8 a paper discharge sensor, 9 a sorter, 10 a sorter feed roller, 11 a transfer/separation unit, 12 a pickup roller of the front first stage, 13 a paper cassette of the front first stage, 14 a middle roller of the front first stage, 15 a pickup roller of the front second stage, 16 a paper cassette of the front second stage, 17 a middle roller of the front second stage, 18 a middle sensor of the front second stage, 19 a pickup roller of the front third stage, 20 a paper cassette of the front third stage, 21 a middle roller of the front third stage, 22 a middle sensor of the front third stage, and 23 a sorting unit.

Generally, copy machines adopt the side paper supply system or the front paper supply system. In some cases, a combination system of the side paper supply system and the front paper supply system is used to supply copy papers. In the case shown in FIG. 1, a copy paper is supplied from one of the side paper cassette 1, the manual paper supply table 2 and a plurality of front paper cassettes 13, 16 and 20, subjected to a copying operation while passing through a development unit including the drum 6 and the transfer/separation unit 11, and then discharged out of a paper discharge unit including the paper discharge sensor 8. For a convenience in use, an additional sorter 23 may be provided at the rear portion of the paper discharge unit. Such a paper feeding path is shown in FIG. 1.

Figure 2:
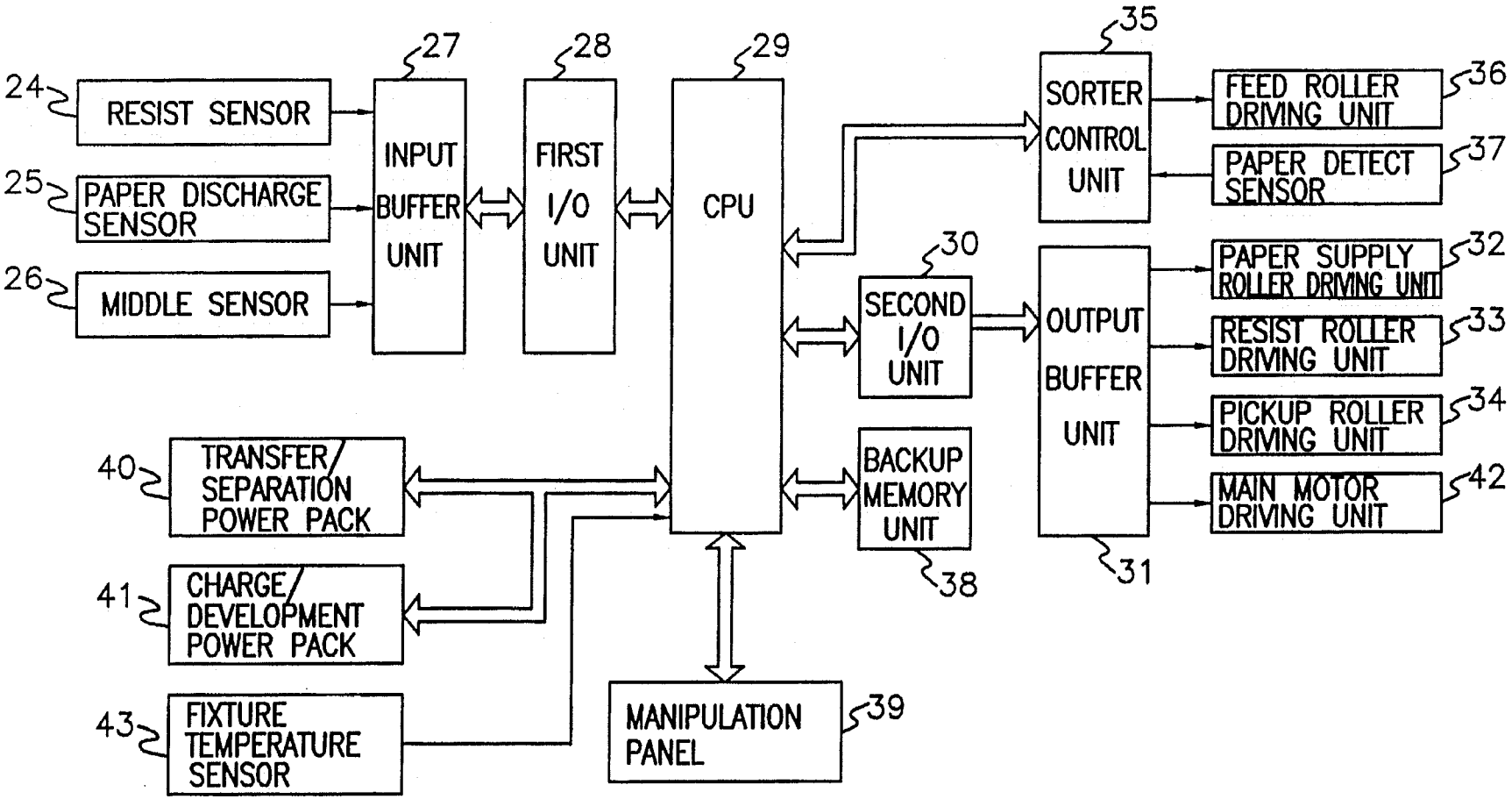
FIG. 2 is a block diagram illustrating a hardware arrangement for achieving a jam recognition and an automatic discharge of jammed papers in a copy machine to which the present invention is applied.
Figures 1, 3A:
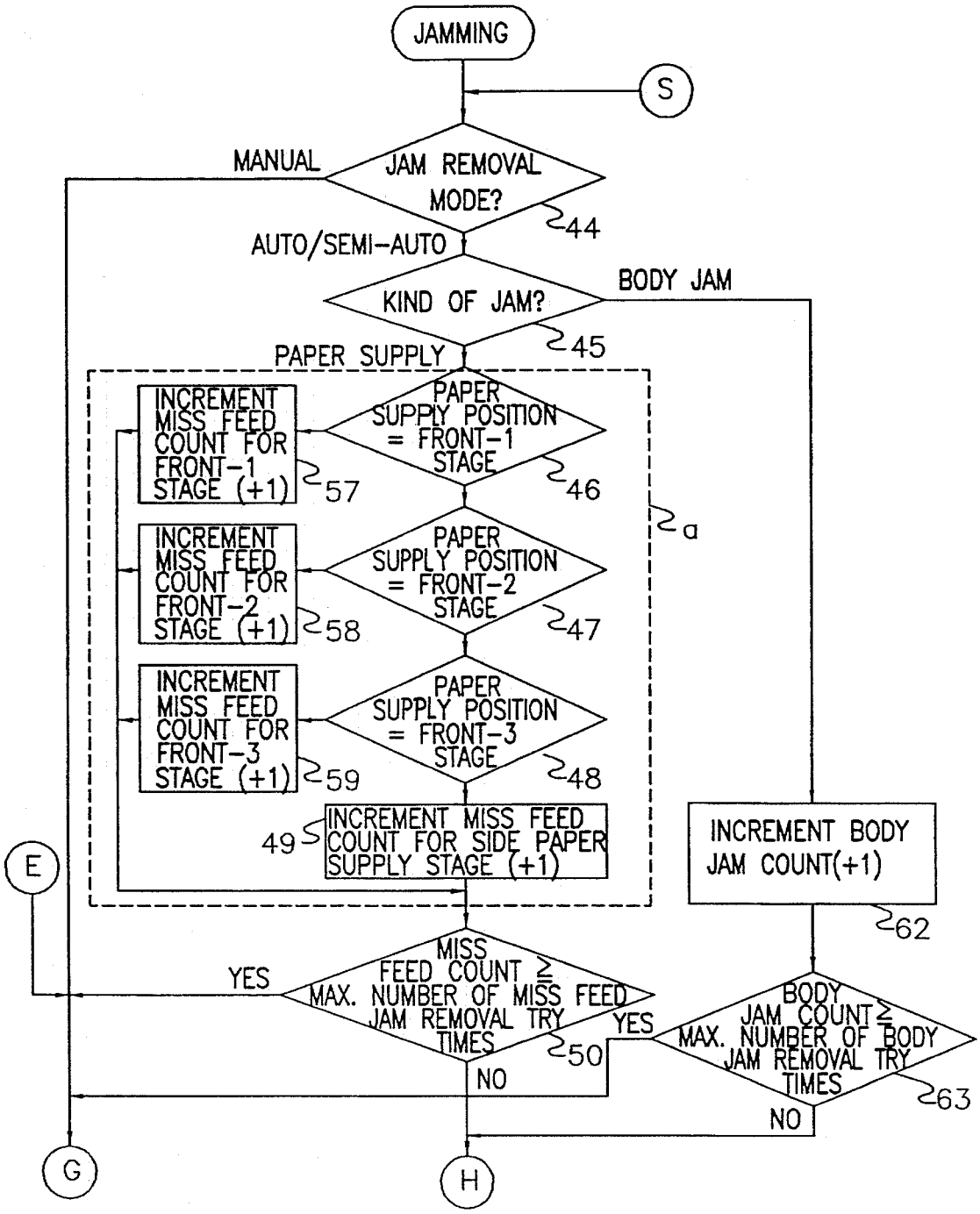
FIGS. 3A(comprising FIGS. 3A-1 and 3A-2)), 3B(comprising FIGS. 3B-1 and 3B-2), 3C, 3D(comprising FIGS. 3D-1, 3D-2 and 3D-3), and 3E(comprising FIGS. 3E-1 and 3E-2) are flowcharts respectively illustrating a method for controlling an automatic discharge of jammed paper in accordance with the present invention.
Figures 2, 3A:
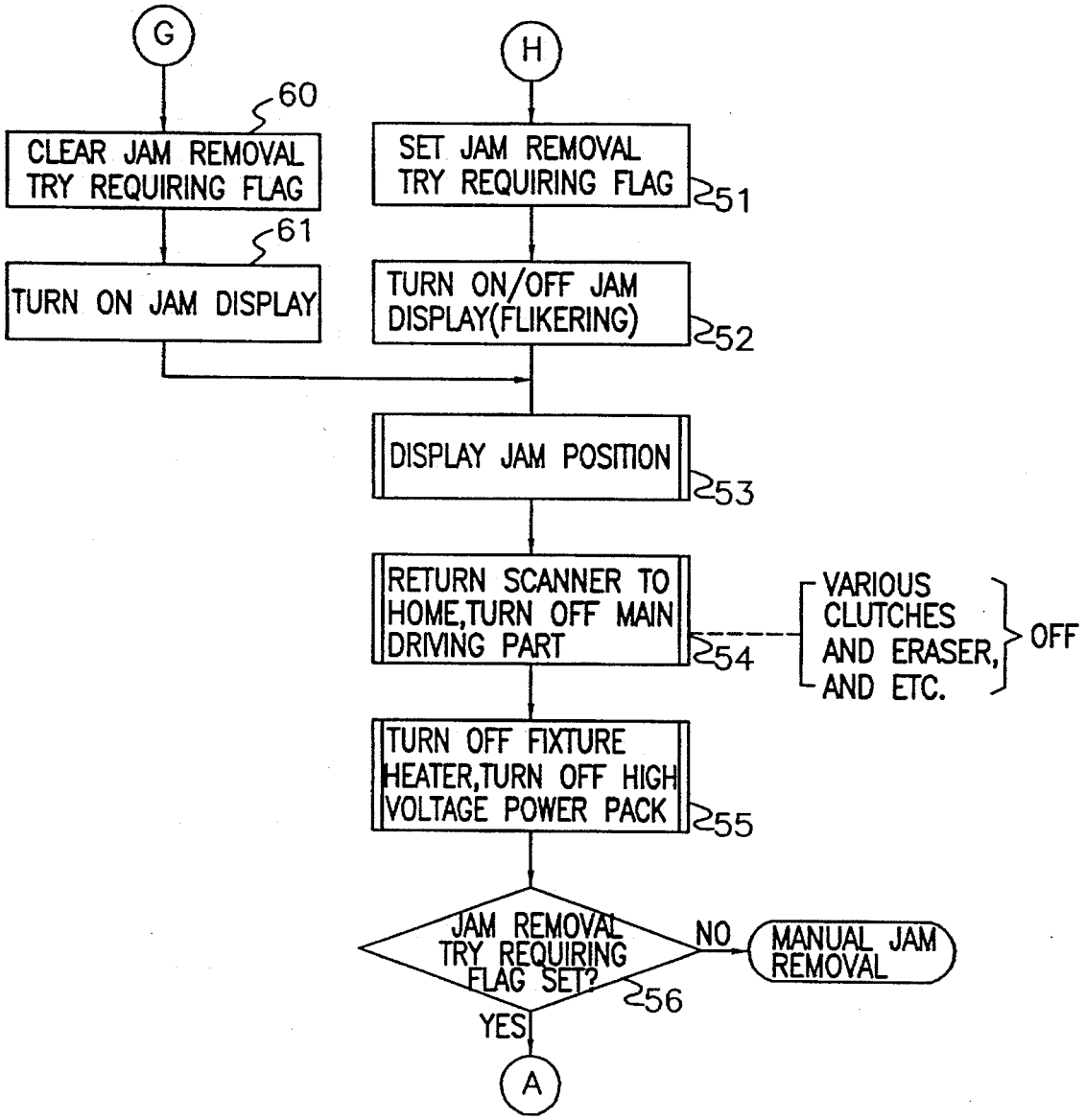
Figures 1, 3B:
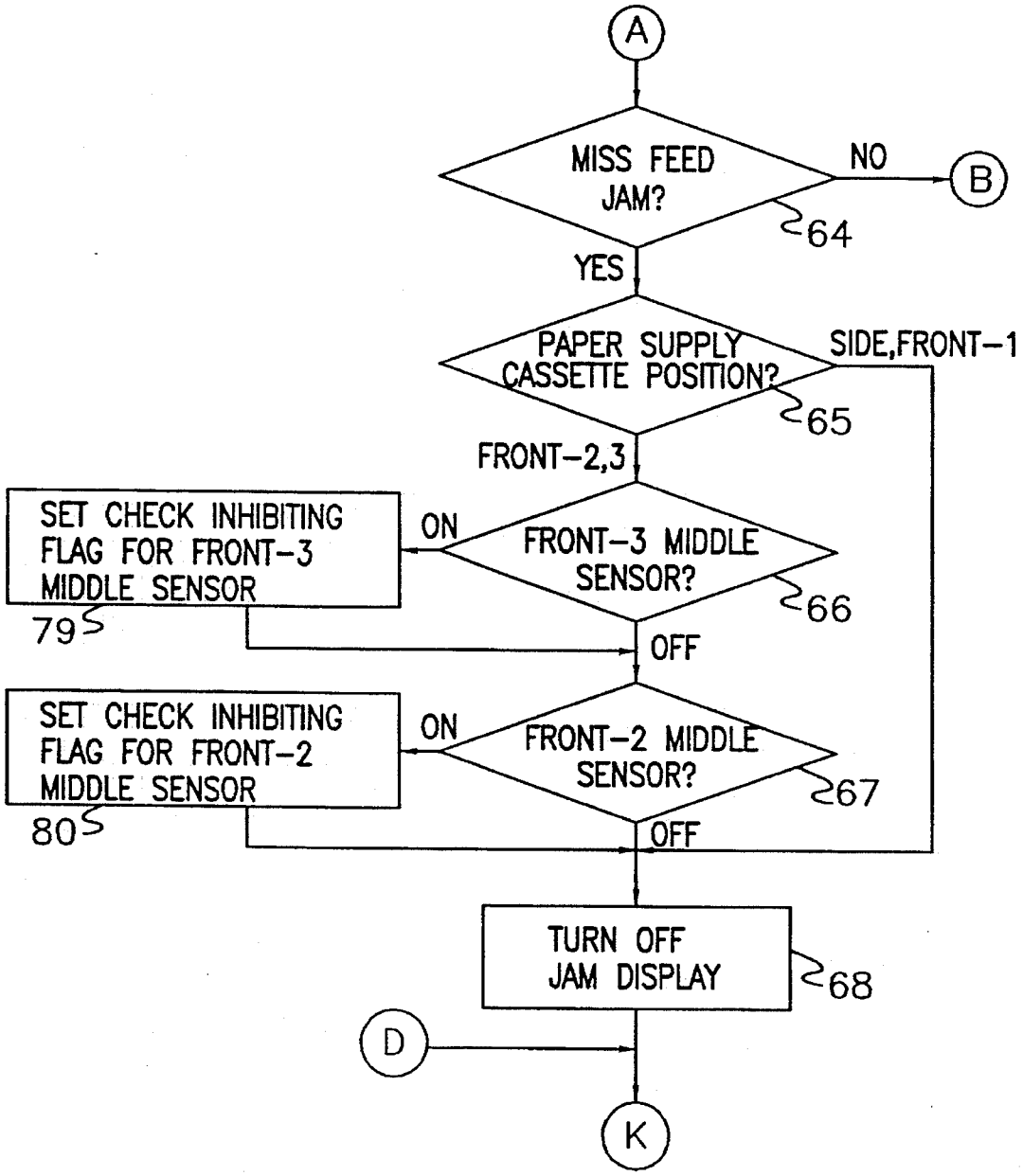
Figures 2, 3B:
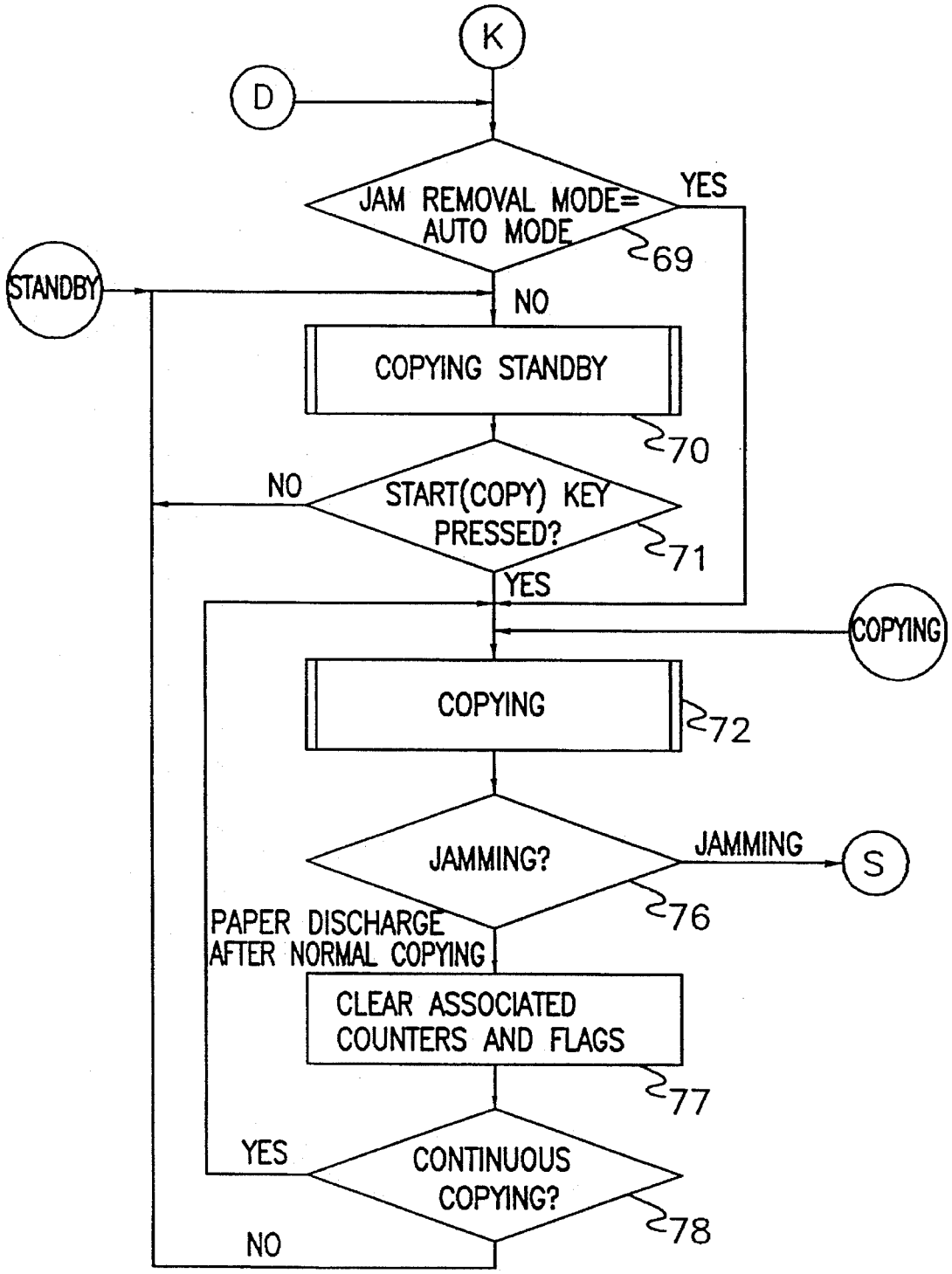
Figure 3C:
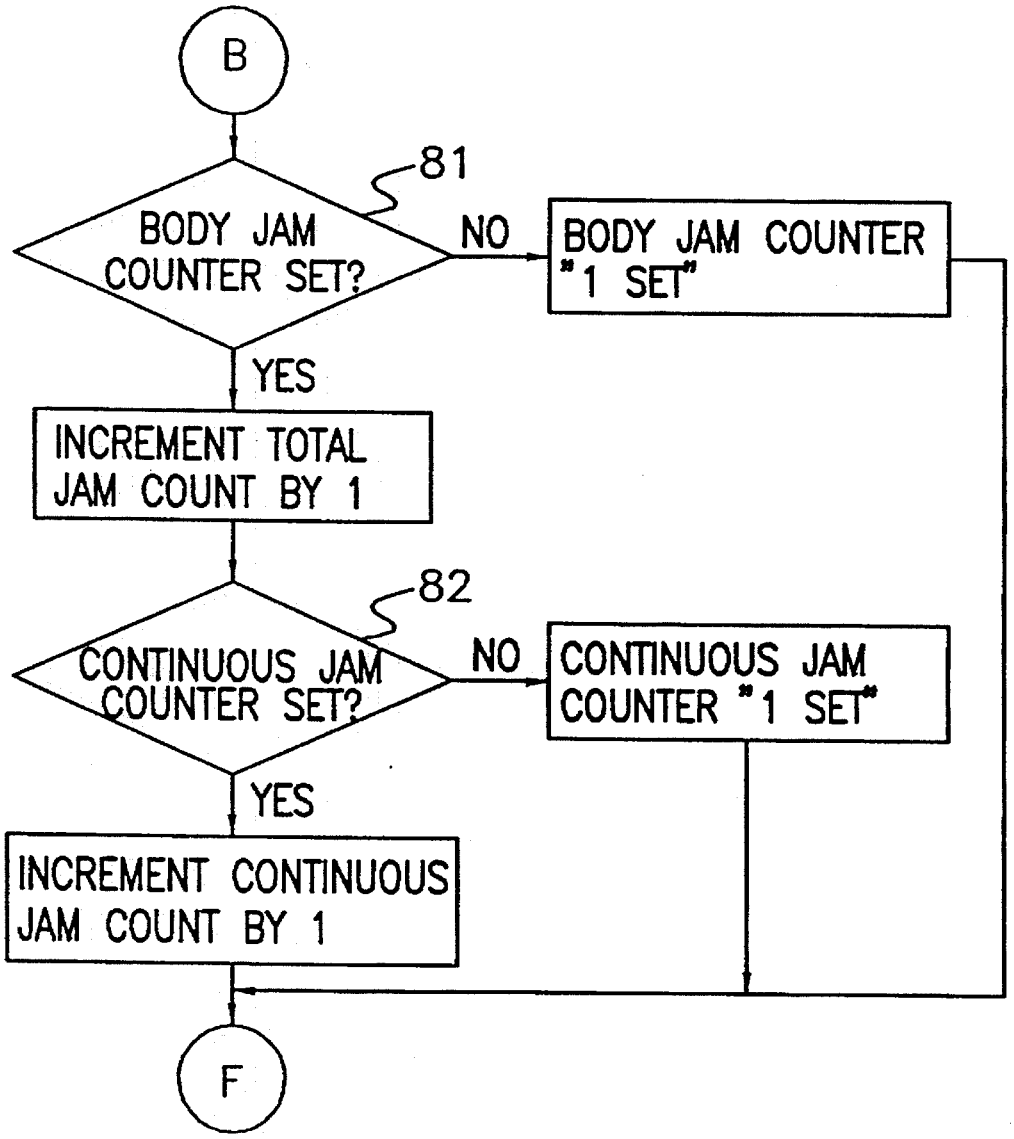
Figures 1, 3D:
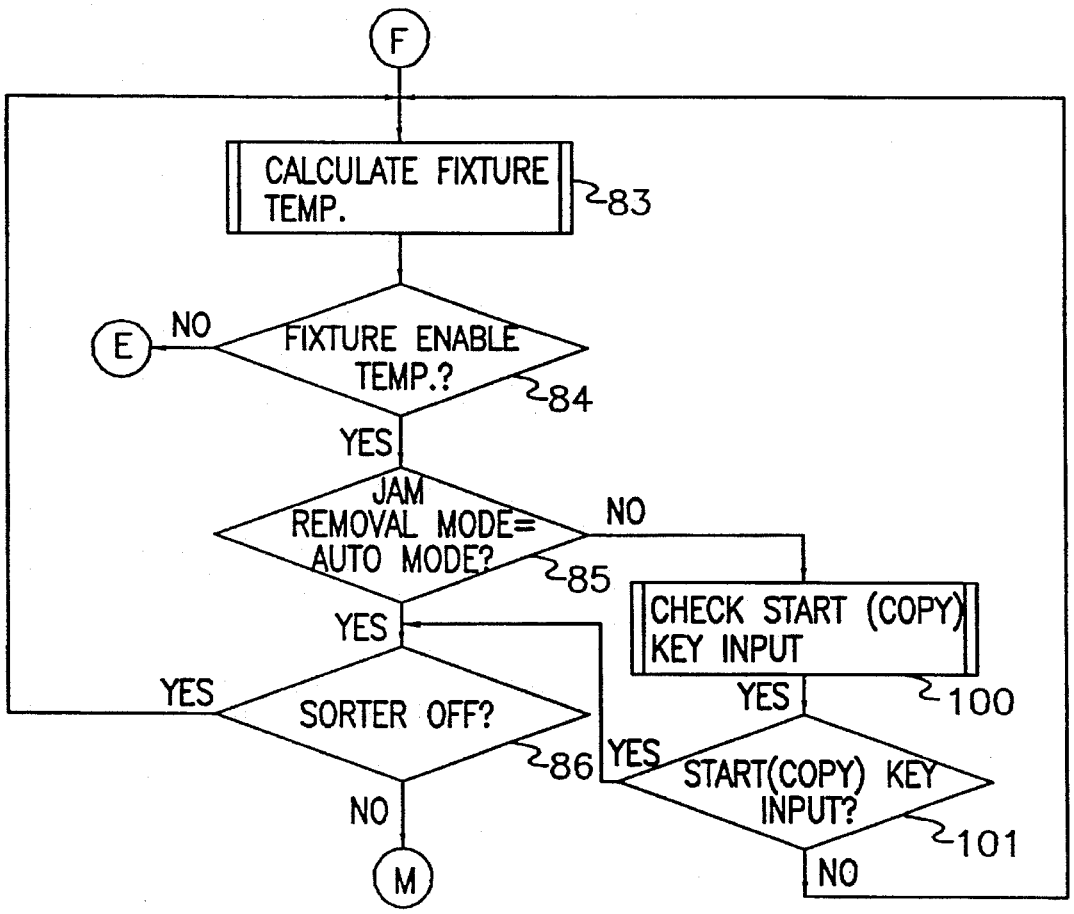
Figures 2, 3D:
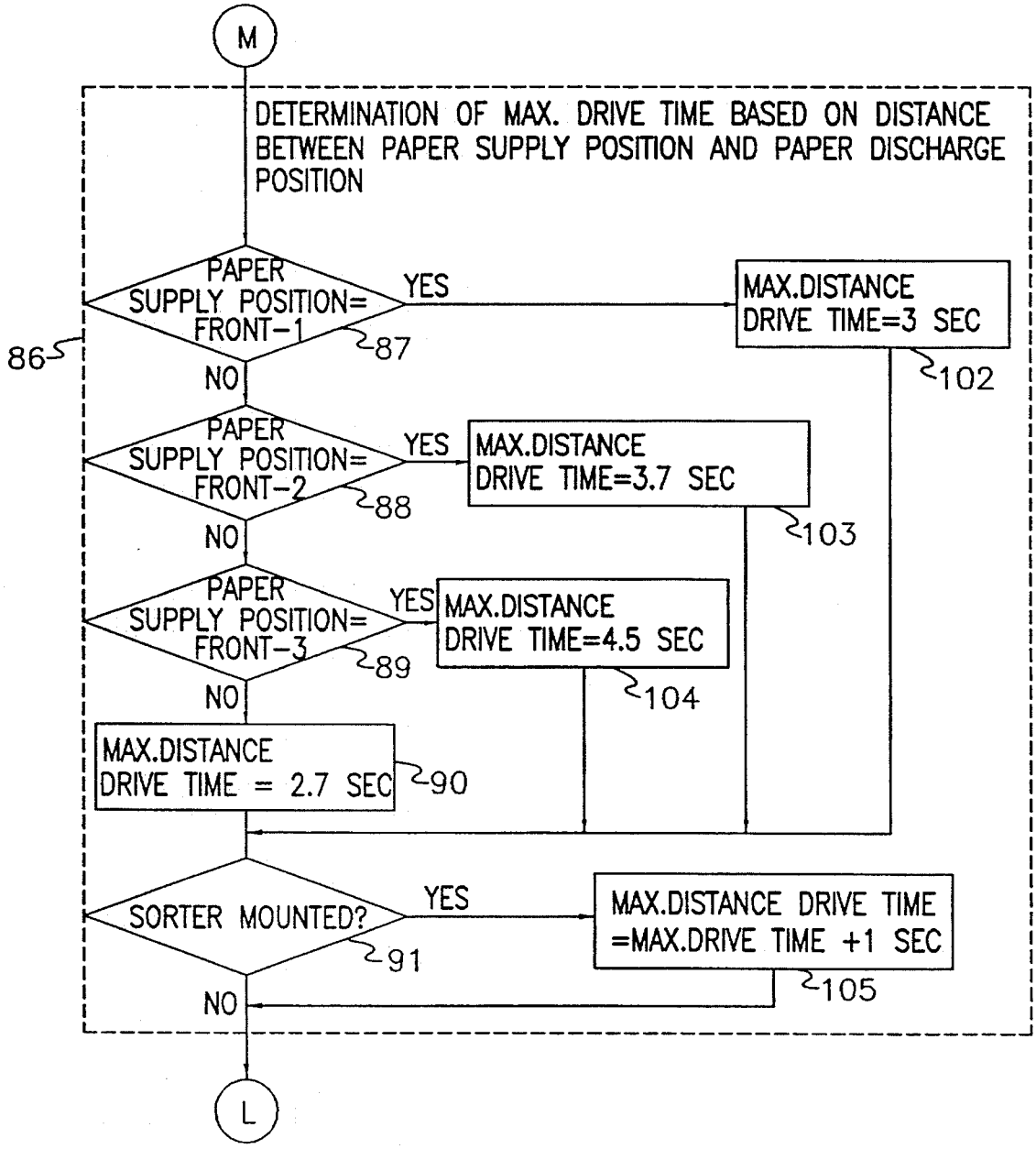
Figures 3, 3D:
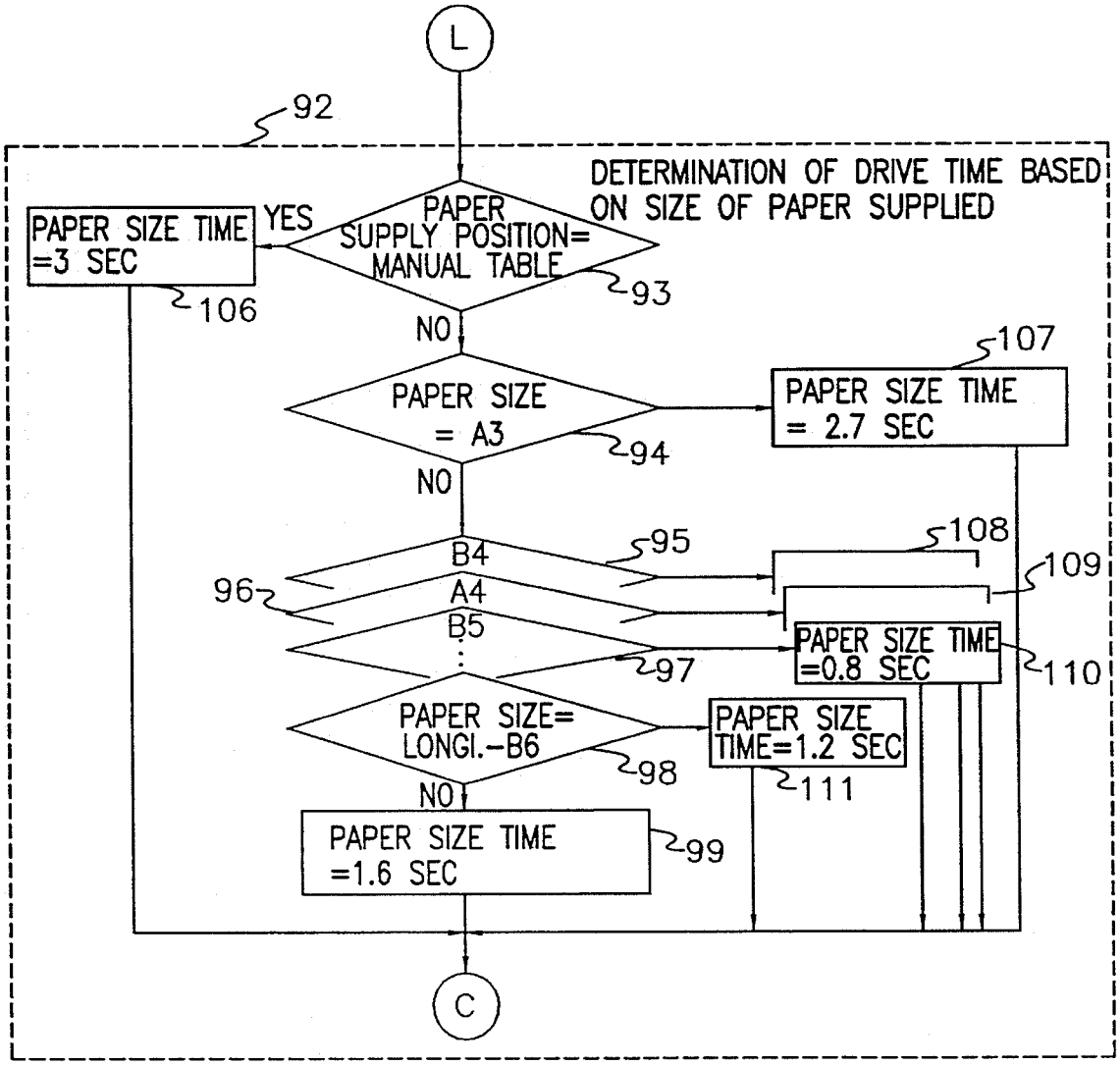
Figures 1, 3E:
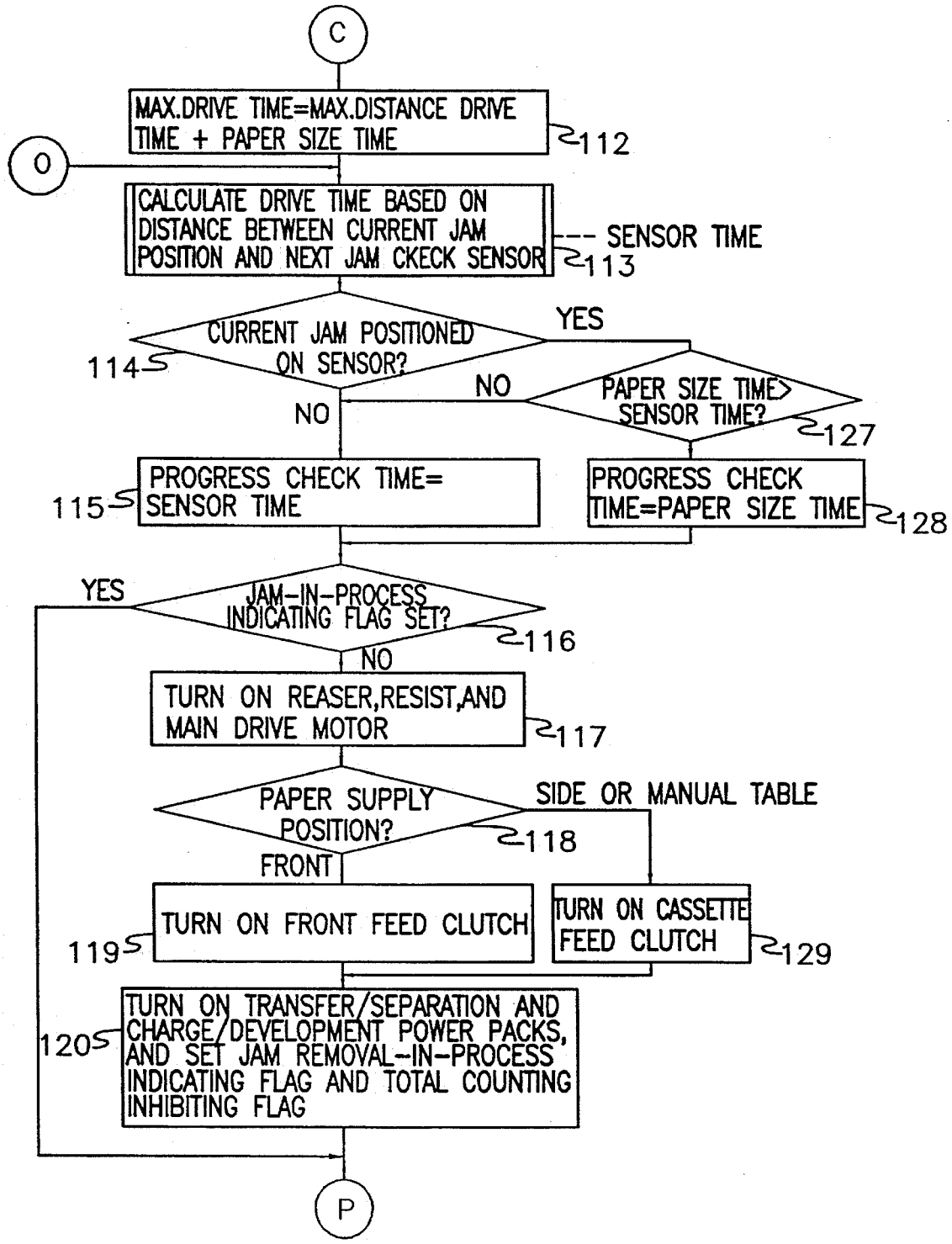
Figures 2, 3E:
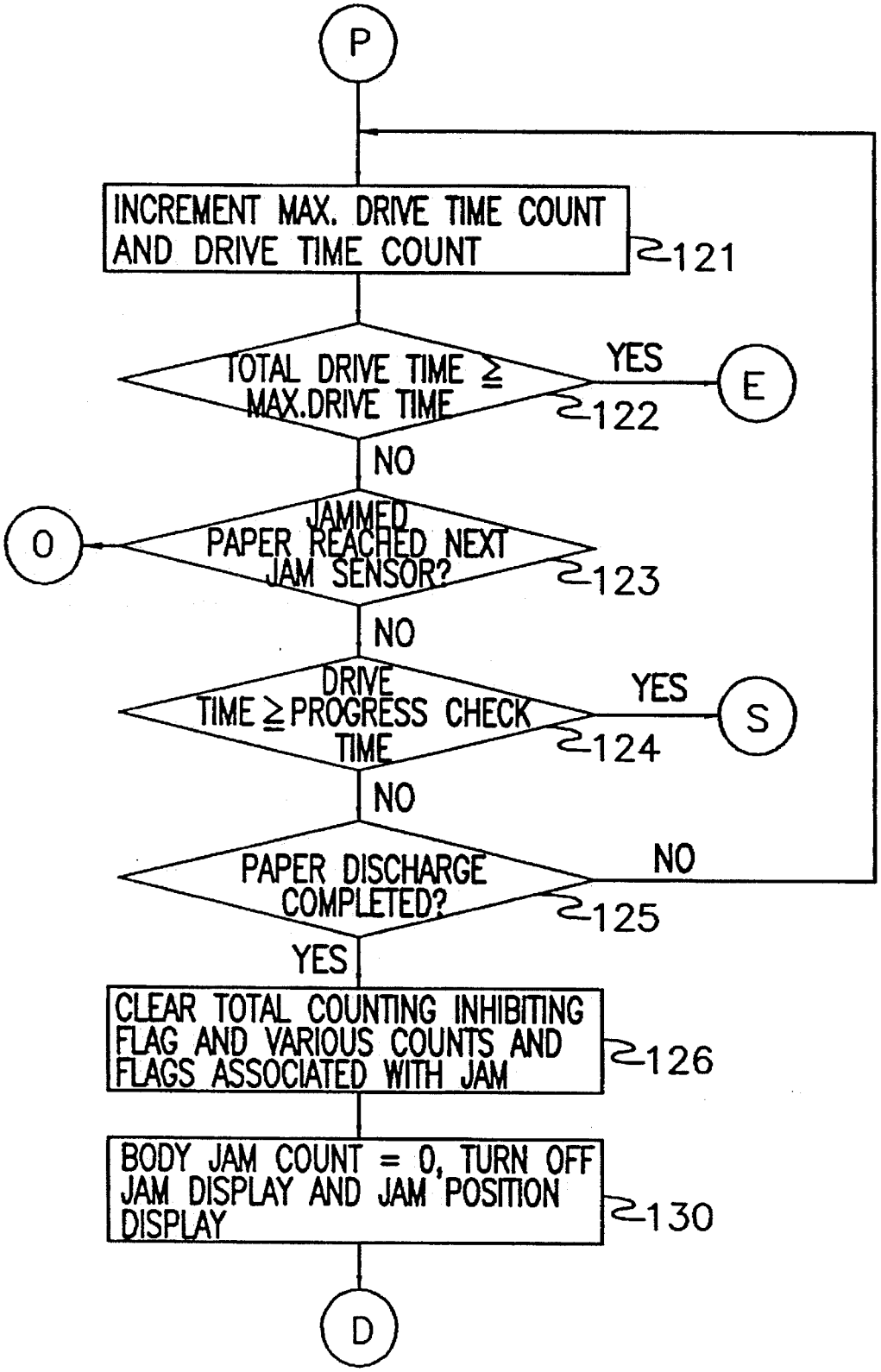

FIG. 2 is a block diagram illustrating a hardware arrangement for achieving a jam recognition and an automatic discharge of jammed papers in the copy machine to which the present invention is applied. In FIG. 2, the reference numeral 24 denotes a resist sensor, 25 a paper discharge sensor, 26 a middle sensor, 27 an input buffer unit, 28 a first input/output (I/O) unit, 29 a central processing unit (CPU), 30 a second I/O unit, 31 an output buffer unit, 32 a paper supply roller driving unit, 33 a resist roller driving unit, 34 a pickup roller driving unit, 35 a sorter control unit, 36 a feed roller driving unit, 37 a paper detect sensor, 38 a backup memory unit, 39 a manipulation panel, 40 a transfer/separation power pack, 41 a charge/development power pack, 42 a main motor driving unit, and 43 a fixture temperature sensor.

As shown in FIG. 2, various jam detect signals generated in the copy machine to which the present invention is applied are received in the resist sensor 24, the paper discharge sensor 25 and the paper detect sensor 37 of the sorter and then applied to the CPU 29 via the input buffer unit 27, the first I/O unit 28 and the sorter control unit 35.

When a jam occurs, the CPU 29 references data stored in the backup memory unit 38 and displays a jam sign and a jam position sign on the manipulation panel 39. The CPU 29 also discriminates whether the current state of the copy machine corresponds to a fixture enable state, based on a signal from the fixture temperature sensor 43. Based on the result of the discrimination, the CPU 29 controls the paper supply roller driving unit 32, the resist roller driving unit 33 and the pickup roller driving unit 34 via the second I/O unit 30 and the output buffer unit 31. The CPU 29 also controls the main motor driving unit 42 to drive the main motor. In a case where the sorter 23 is provided, the CPU 29 controls the feed roller driving unit 36 via the sorter control unit 35.

In this case, the transfer/separation power pack 40 and the charge/development power pack 41 are turned on for preventing toner to scatter.

FIGS. 3A to 3E are flow charts respectively illustrating a method for controlling an automatic discharge of jammed papers in accordance with an embodiment of the present invention.

In accordance with the control method illustrated in FIGS. 3A to 3E, first, a discrimination is made about whether a jam removal mode currently set corresponds to an automatic/semi-automatic mode or a manual mode when a jam has occurred (Step 44).

Where the manual jam removal mode has been set, a flag for requiring a jam removing try is cleared (Step 60). A jam display lamp is turned on (Step 61). Thereafter, a jam position sign is displayed (Step 53). A scanner is then returned to its home position, while the main driving unit is turned off (Step 54). For avoiding an occurrence of fire and the user from getting burnt, a fixture heater and a high voltage power pack are also turned off (Step 55). Then, the jammed paper is manually removed.

On the other hand, if it is determined at the step 44 that the automatic/semi-automatic jam removal mode has been set, kind of the generated jam is then determined (Step 45). Where the generated jam corresponds to a body jam generated in a body of the copy machine, a count for the body jam is incremented by one (Step 62). The incremented count is then compared with a predetermined maximum number of try times for body jam removal (Step 63). If the count is not less than the predetermined maximum number of body jam removal try times, the same procedure as in the manual jam removal mode (including the steps 60, 61, and 53 to 55) is then carried out. If not, the jam removal try requiring flag is then set (Step 51). Thereafter, the jam display lamp is repeatedly turned on and off to generate a flickering jam sign (Step 52). Also, the jam position sign is displayed (Step 53). Subsequently, all the driving units are stopped (Steps 54 and 55).

Where it is determined at the step 45 that the generated jam corresponds to a paper supply jam generated at the paper supply part of the copy machine, a discrimination is made about what one of the paper supply positions does the current paper supply position correspond to, while incrementing a count for miss feed by one (Procedure a). In the illustrated case using front paper supply cassettes of three stages and a side cassette of one stage, sequential determinations are made about whether the paper supply position corresponds to the front first stage, to the front second stage, and then to the front third stage (Steps 46 to 48), while a count for miss feed to the corresponding front paper supply stage is incremented by one for each determination (Step 57 to 59). Where the paper supply position does not corresponds to any of the three front paper supply stages, it is regarded that the paper supply position corresponds to the side paper supply stage (Step 49). In this case, a count for side supply miss feed is incremented by one.

Thereafter, the incremented count for each of the paper supply positions is compared with a predetermined maximum number of miss feed jam removal try times (Step 50). When the count is not less than the predetermined maximum number of miss feed jam removal try times, the same procedure as in the manual jam removal mode (including the steps 60, 61, and 53 to 55) is then carried out. If not, the jam removal try requiring flag is then set (Step 51), as in the case of the body jam. Thereafter, the jam display lamp is repeatedly turned on and off to generate a flickering jam sign (Step 52). Also, the jam position sign is displayed (Step 53). Subsequently, all the driving units are stopped (Steps 54 and 55).

The distinction between the miss feed jam and the body jam is for an efficiency of control, because a normal picture copy can be achieved in the case of the miss feed jam, even though a picture quality of the jammed paper is not ensured in the case of the body jam.

In accordance with the present invention, the jam display lamp is maintained at its turn-on state in the case where the manual jam removal is required (Step 61), whereas it is repeatedly turned on and off to generate a flickering jam sign in the case where the automatic jam removal is required (Step 52). As the flickering jam sign is generated, the user can recognize that the current state corresponds to the state that the jam is being automatically removed or the automatic jam removal enable state. In particular, where the jam removal mode corresponds to the automatic removal mode in the illustrated case, the flickering jam sign is indicative of the state that the jam is being automatically removed. Where the jam removal mode corresponds to the semi-automatic removal mode, the flickering jam sign is indicative of the automatic jam removal enable state. At the automatic jam removal enable state, the automatic jam removal can be carried out when the user presses down a desired key (namely, a copy key).

After stoppage of all the driving units (Steps 54 and 55), a determination is made about whether the jam removal try requiring flag has been set (Step 56). If it is determined that the jam removal try requiring flag has been set, a determination is then made about whether the generated jam corresponds to the miss feed jam at the paper supply part of the copy machine (Step 64). Where the generated jam corresponds to the miss feed jam, namely, the jam generated at the paper supply part, the current paper supply cassette position is checked (Step 65). When the current paper supply cassette position corresponds to one of the side paper supply cassette position and the front first stage, the jam display lamp maintained at its turn-on state is turned off (Step 68). On the other hand, when the current paper supply cassette position corresponds to one of the front second stage and the front third stage, a determination is made about whether the corresponding middle sensor is at its ON state (Steps 66 and 67). Where the middle sensor is at its ON state, a middle sensor check inhibiting flag for the corresponding front cassette is set (Steps 79 and 80). The jam display lamp maintained at its turn-on state is then turned off (Step 68). That is, in the case of the miss feed jam at the front second stage or the front third stage (Steps 66 and 67), the middle sensor for the front second stage or the front third stage is forced to check the presence of paper no longer (Step 79 and 80) (this procedure is omitted for the front first stage because there is no middle sensor for the front first stage). Thereafter, the jam display lamp is turned off (Step 68). Thus, the overall control is returned to the normal condition.

After the overall control is returned to the normal condition, a determination is made about whether the set jam removal mode corresponds to the automatic removal mode (Step 69). Where the set jam removal mode corresponds to the automatic removal mode, a copying operation is immediately carried out (Step 72). Where the set jam removal mode does not correspond to the automatic removal mode, namely, corresponds to the semi-automatic removal mode, a copying standby state is maintained (Step 70). When a copying start key is pressed down at the copying standby state (Step 71), the copying operation is initiated (Step 72). The copying operation at the step 72 will be described in detail. During the normal copying operation, a count of a copying counter being referenced for a determination about the jam removal mode change is incremented by one for each copying. Hereinafter, the copying counter is referred to as "mode change reference counter". Thereafter, a determination is made about whether the front middle sensor check inhibiting flag has been set. Where the front middle sensor check inhibiting flag has been set, the front middle sensor check is omitted and a check procedure following the front middle sensor check is directly executed. When a copy paper is discharged, counts of a continuous jam counter and a paper supply position miss feed counter are initialized.

When a jam is generated during the copying operation at the step 72, the procedure is returned to the initial step 44. After the copying operation is normally completed (that is, when the normal copying operation is completed without generation of any jam or when the generated jam is removed), the count for each paper supply position and the middle sensor check inhibiting flag for each of the front second stage and the front third stage are cleared. Also, the continuous jam flag and the count of the continuous jam counter are cleared. That is, all the counts of associated counters and all the associated flags except for the counts of the mode change reference counter and the total jam counter are cleared (Step 77).

Subsequently, a check is made about whether the current copying mode corresponds to a continuous copying mode (Step 78). Where the current copying mode corresponds to the continuous copying mode, the copying operation is continued until the number of copied papers reaches a predetermined value. Where the current copying mode does not correspond to the continuous copying mode or the operation in the continuous copying mode is completed, the procedure is returned to the copying standby step 70.

Meanwhile, where the jam generated at the state that the jam removal try requiring flag has been set is determined to be the body jam at the step 64, the counts of the total jam counter and the continuous jam counter are incremented by one, respectively (Steps 81 and 82).

The temperature of the fixture roller is then measured and calculated (Step 83). Thereafter, a determination is made about whether the calculated temperature has reached the fixture enable temperature (Step 84). Where the temperature of the fixture roller has not reached the fixture enable temperature yet, the procedure is jumped directly to the step 60 for executing the operation in the manual removal mode. When the temperature of the fixture roller has reached the fixture enable temperature, a check is made about kind of the current jam removal mode (Step 85). Where the current jam removal mode corresponds to the automatic removal mode, a forced paper discharge is directly executed. In the case of the semi-automatic removal mode, the forced paper discharge is executed when the user presses down the copying start key (Steps 100 and 101). During the standby state until the copying start key is pressed down, a check is periodically made about whether the temperature of the fixture roller has been decreased below the fixture temperature (Step 84). When the temperature of the fixture roller has been decreased below the fixture temperature, a transition of the current jam removal mode to the manual removal mode is executed so as to prevent the fixture part of the copy machine from being severely contaminated during the forced paper discharge operation.

Where the copy machine is provided with the sorter, a determination is also made about whether the sorter is at its opened state, before the forced paper discharge operation is initiated. The forced paper discharge operation is carried out only when the sorter is maintained at its closed state that it can receive papers normally. Where the sorter is at its opened state, the forced paper discharge is on standby until the sorter is closed.

Now, the procedure of forcedly discharging a jammed paper will be described. First, a maximum drive time is determined by calculating a maximum drive time based on the distance between the paper supply position and the paper discharge sensor position (hereinafter, referred to as "maximum distance drive time") (Procedure 86). Where the sorter is mounted, the position of the sorter sensor is used as the paper discharge position for determining the maximum drive time (Step 91). The maximum drive time is variable, depending on size, construction and performance of the copy machine. In the illustrated case, the maximum distance drive time is predetermined to be 3 seconds for the front first stage (Steps 87 and 102), 3.7 seconds for the front second stage (Steps 88 and 103), and 4.5 seconds for the front third stage (Steps 89 and 104). Where the current paper supply position corresponds to the side paper supply cassette position, the maximum distance drive time is predetermined to be 2.7 seconds (Step 90). On the other and, where the sorter is mounted (Step 91), the maximum distance drive time is predetermined to correspond to the time obtained by adding one second to the maximum distance drive time predetermined for the current paper supply position (Step 105).

Thereafter, a drive time based on the size of copy paper (hereinafter, referred to as "paper size time") is determined. The paper size time is calculated on the basis of the size of the jammed paper (namely, the size of the copy paper supplied) (Procedure 92). In this case, the paper size time is predetermined to be 3 seconds where the paper supply position corresponds to the manual table position (Steps 93 and 106). The paper size time is also predetermined to be 2.7 seconds for the paper size of A3 (Steps 94 and 107), 2.4 seconds for the paper size of B4 (Steps 95 and 108), 1.4 seconds for the paper size of A4 (Steps 96 and 109), 0.8 seconds for the paper size of B5 (Steps 97 and 110), 1.2 seconds for the paper size of longitudinal B6 (Steps 98 and 111), and 1.6 seconds for the paper size smaller than B6 (Step 99). The paper size time is variable, depending on the copy velocity of the copy machine. Accordingly, the paper size time is determined in accordance with the equation, t=S/V (S: distance or paper size, V: drive velocity (velocity of copy machine), and t: time).

Thereafter, the maximum drive time is calculated by summing the maximum distance drive time and paper size time calculated through the procedures 86 and 92 (Step 112). Then, a calculation is made for a drive time based on the distance between the current position where the jam has been generated and a next jam check sensor following the current position (hereinafter, referred to as "sensor time") (Step 113).

Subsequently, a check is made about whether the currently jammed paper is positioned on the jam check sensor (Step 114). Where the jammed paper is not positioned on the jam check sensor, the sensor time is determined as a progress check time (Step 115). However, where the jammed paper is positioned on the jam check sensor, the sensor time is compared with the paper size time (Step 127). The higher one of the compared times is then determined as the progress check time (Steps 115 and 128).

Thereafter, a check is made about whether a jam-in-process indicating flag indicative of the forced discharge driving for removal of jam has been set (Step 116). Where the jam-in-process indicating flag has been set, the position of the jammed paper moved by the forced drive is checked while counting the maximum drive time and the time elapsed from the point of time when the copy machine begins to drive for discharging the jammed paper (Step 121). Where the jam-in-process indicating flag has not been set, the eraser, the resist roller and the main drive motor are turned on (Step 117). A determination is then made about the current paper supply position (Step 118). Where the current paper supply position corresponds to one of the front paper supply positions, the front feed clutch is switched to its ON state (Step 117). On the other hand, where the current paper supply position is determined to correspond to one of the side paper supply position and the manual table paper supply position, the cassette feed clutch is switched to its ON state for its driving (Step 129). Thereafter, the transfer/separation power pack and charge/development power pack is switched to its ON state so as to prevent toner from being scattered upon removing the jammed paper (Step 120). At the step 120, the jam removal-in-process indicating flag is also set so as to continuously count the total drive time and the drive time elapsed from the point of time when the copy machine begun to drive during the driving of the copy machine. Taking into consideration the fact that a picture may be badly copied on the jammed paper, a total counting inhibiting flag is also set so as to inhibit a copy counting for the jammed paper. Subsequently, the position of the jammed paper moved by the forced driving is checked while incrementing the count for the maximum drive time for comparing the total drive time and the count for the drive time (elapsed from the point of time when the copy machine begun to drive) for comparing the progress check time (Step 121). Where the total drive time is not less than the maximum drive time calculated on the basis of the distance between the paper supply position and the paper discharge position (Step 22), the jam removal operation in the automatic mode is stopped. The procedure is then returned to the procedure in the manual removal mode, namely, to "E" of FIG. 3A, so as to minimize a deterioration of the driving parts of the copy machine possibly occurring upon the forced driving.

On the other hand, where the total drive time is determined to be less than the maximum drive time at the step 122, a check is made about whether the jammed paper has reached the next jam check sensor (Step 123). When the jammed paper has reached the next jam check sensor, a drive time is calculated on the basis of the distance to the next jam check sensor and the calculated drive time is predetermined as the progress check time (Steps 113 to 115, and Steps 127 and 128).

Where the drive time elapsed from the point of time when the copy machine begun to drive is not less than the predetermined progress check time (Step 124), a determination is once made that the jammed paper has not been discharged. The procedure is then returned to the initial step ("S" of FIG. 3A) so as to repeatedly execute the above-mentioned procedures. Thus, the possibility of automatically removing the jammed paper within the minimum time can be determined.

After the jammed paper is completely discharged out of the copy machine through the above-mentioned procedures (Step 125), the total counting inhibiting flag and various associated flags are cleared, while the body jam counter is reset (Step 126). Display lamps on the manipulation panel associated with the jam are turned off so as to be normally on standby. Thus, all the procedures are ended.

Meanwhile, an appropriate jam removal mode is selected, based the operation condition of the copy machine in accordance with the present invention. That is, the jam removal mode is automatically changed, based on the operation condition of the copy machine, namely, the jam generation rate. Alternatively, the user changes the jam removal mode through his manual key manipulation. This will now be described in conjunction with FIGS. 4 and 5.

Figure 4:
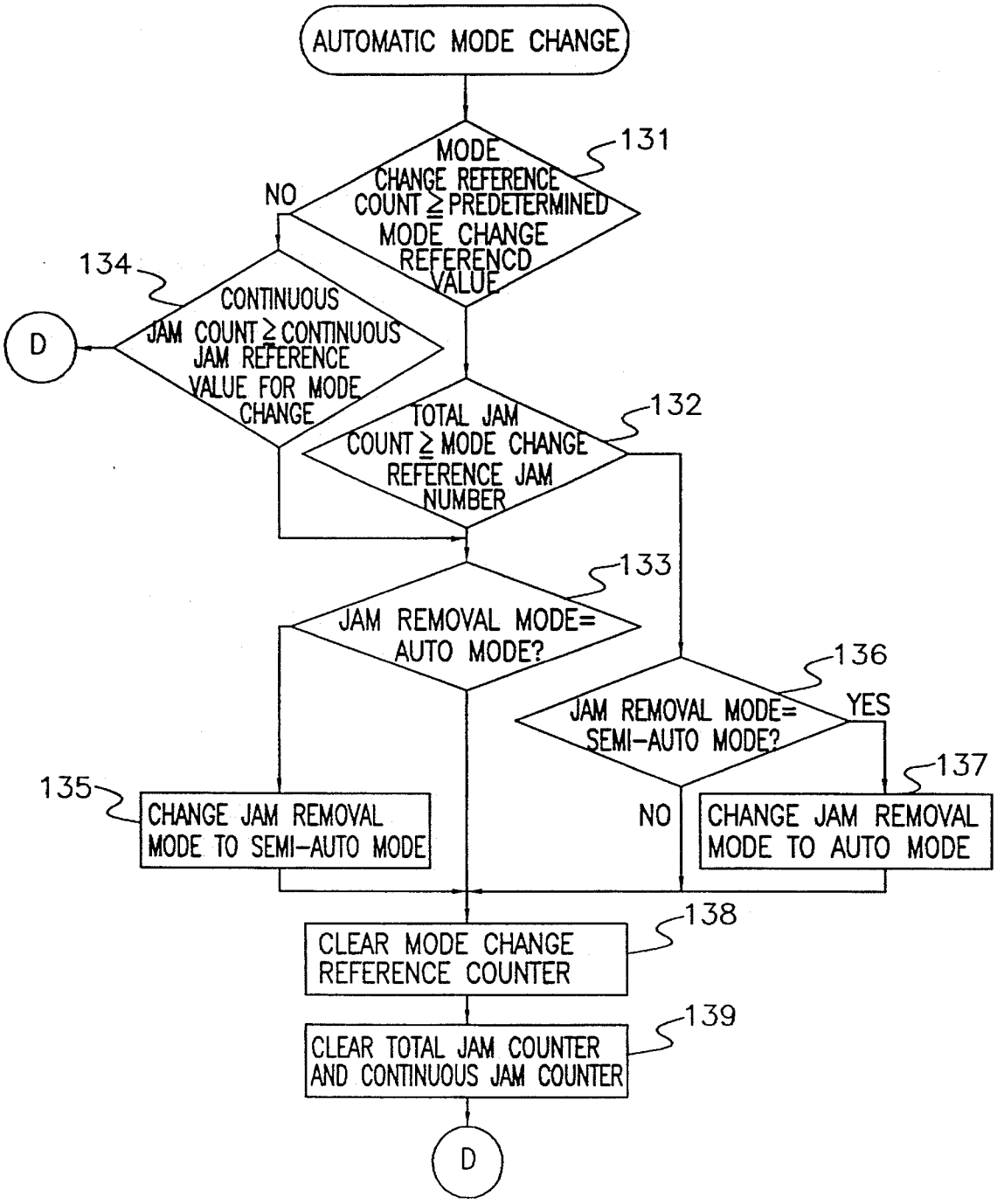
FIG. 4 is a flow chart illustrating a procedure of executing an automatic mode change function in accordance with the present invention.

FIG. 4 is a flow chart illustrating a procedure of executing the automatic mode change function in accordance with the present invention. This procedure is preferably executed immediately after the jammed paper is discharged through the above-mentioned steps 125 to 130.

After completion of the jammed paper discharge, first, a determination is made about whether a mode change reference count of a mode change reference counter indicative of the number of repeated copying operations and incremented by one for every copying operation is not less than a predetermined mode change reference value (Step 131). In a preferred embodiment, the predetermined mode change reference value is 100 so as to determine whether a mode change is required to be executed after every 100-copying operation. If the mode change reference count has not reached the predetermined mode change reference value, a determination is then made about whether a continuous jam count has reached a continuous jam reference value for mode change (Step 134). When the continuous jam count is less than the continuous jam reference value, the procedure proceeds to the step 69 of the procedure for determining whether the current jam removal mode is the automatic removal mode. When the continuous jam count is not less than the continuous jam reference value, a check is made about kind of the current jam removal mode (Step 133). Where the current jam removal mode corresponds to the automatic removal mode, it is automatically changed to the semi-automatic removal mode (Step 135).

When the mode change reference count has reached the predetermined mode change reference value, a determination is then made about whether the total jam count has reached a change reference jam value (Step 132). Where the total jam count is not less than the change reference jam value, a check is made about kind of the current jam removal mode (Step 133). Where the current jam removal mode corresponds to the automatic removal mode, it is automatically changed to the semi-automatic removal mode (Step 135). On the other hand, where the total jam count is less than the change reference jam value, a check is made about whether the current jam removal mode corresponds to the semi-automatic removal mode (Step 136). Where the current jam removal mode corresponds to the semi-automatic removal mode, it is automatically changed to the automatic removal mode (Step 137).

Thereafter, the mode change reference counter is cleared (Step 138). Also, the total jam counter and the continuous jam counter are cleared (Step 139). The procedure is then returned to the step 69 of the procedure for determining whether the current jam removal mode is the automatic removal mode. Where the current jam removal mode corresponds to the automatic removal mode, the copying operation at the step 72 is continuously carried out. At this time, the paper not copied due to the jam is also re-copied. In the case of the semi-automatic removal mode, the procedure is returned to the copying standby step 70 so as to be on standby.

Figure 5:
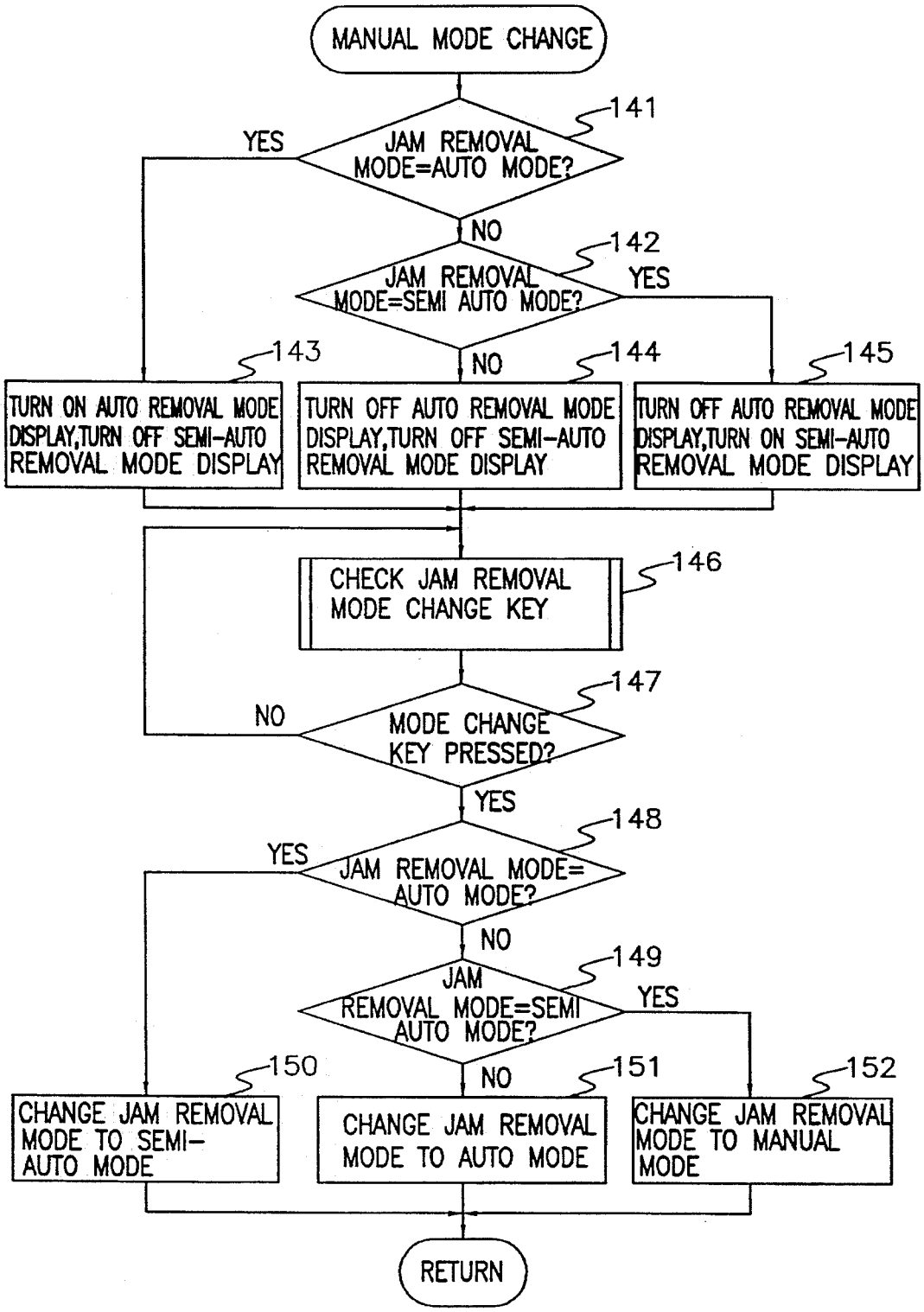
FIG. 5 is a flow chart illustrating a routine for executing the manual mode change function in accordance with the present invention.

FIG. 5 is a flow chart illustrating a routine for executing the manual mode change function in accordance with the present invention. This routine is the procedure executed when the user requires manually a mode change.

As shown in FIG. 5, first, where the current jam removal mode corresponds to the automatic removal mode, a light emitting diode for displaying the automatic removal mode is turned on. Where the current jam removal mode corresponds to the semi-automatic removal mode, a light emitting diode for displaying the semi-automatic removal mode is turned on. These operations are achieved through the steps 141 to 145.

Thereafter, a standby state is kept until the user presses down a mode change key while checking a jam removal mode change key (Step 146). When the mode change key is pressed down (Step 147), the jam removal mode is changed (Steps 148 to 152). In the illustrated case, where the current jam removal mode corresponds to the automatic removal mode (Step 148), it is changed to the semi-automatic removal mode (Step 150). On the other hand, where the current jam removal mode corresponds to the semi-automatic removal mode (Step 149), it is changed to the manual removal mode (Step 152). Where the current jam removal mode corresponds to neither of the automatic removal mode or the semi-automatic removal mode, that is, the current jam removal mode corresponds to the manual removal mode, it is changed to the automatic removal mode (Step 151).

As apparent from the above description, the present invention provides three jam removal modes, that is, the automatic jam removal mode for performing automatic try for removal of jam, the semi-automatic jam removal mode for performing try for removal of jam when the user presses down the copying start key, and the manual jam removal mode for stopping the copy machine upon generation of jam, as in existing copy machines. Accordingly, it is possible to prevent deterioration of driving parts such as abrasion of rollers caused by forced discharge of jammed papers. In accordance with the present invention, the user can recognize the current jam removal mode easily because the current jam removal mode is displayed on the manipulation panel by light emitting diodes. When the number of jams generated during the copying operation for a predetermined period is more than a predetermined reference jam generation rate under a condition that the automatic jam removal mode is set, the jam removal mode is automatically changed from the automatic removal mode to the semi-automatic removal mode. On the other hand, when the number of jams generated is less than the predetermined reference jam generation rate under a condition that the semi-automatic removal mode is set, the jam removal mode is automatically changed from the semi-automatic removal mode to the automatic removal mode. Furthermore, the user can change the jam removal mode directly using the jam removal mode change key.

Figure 6:
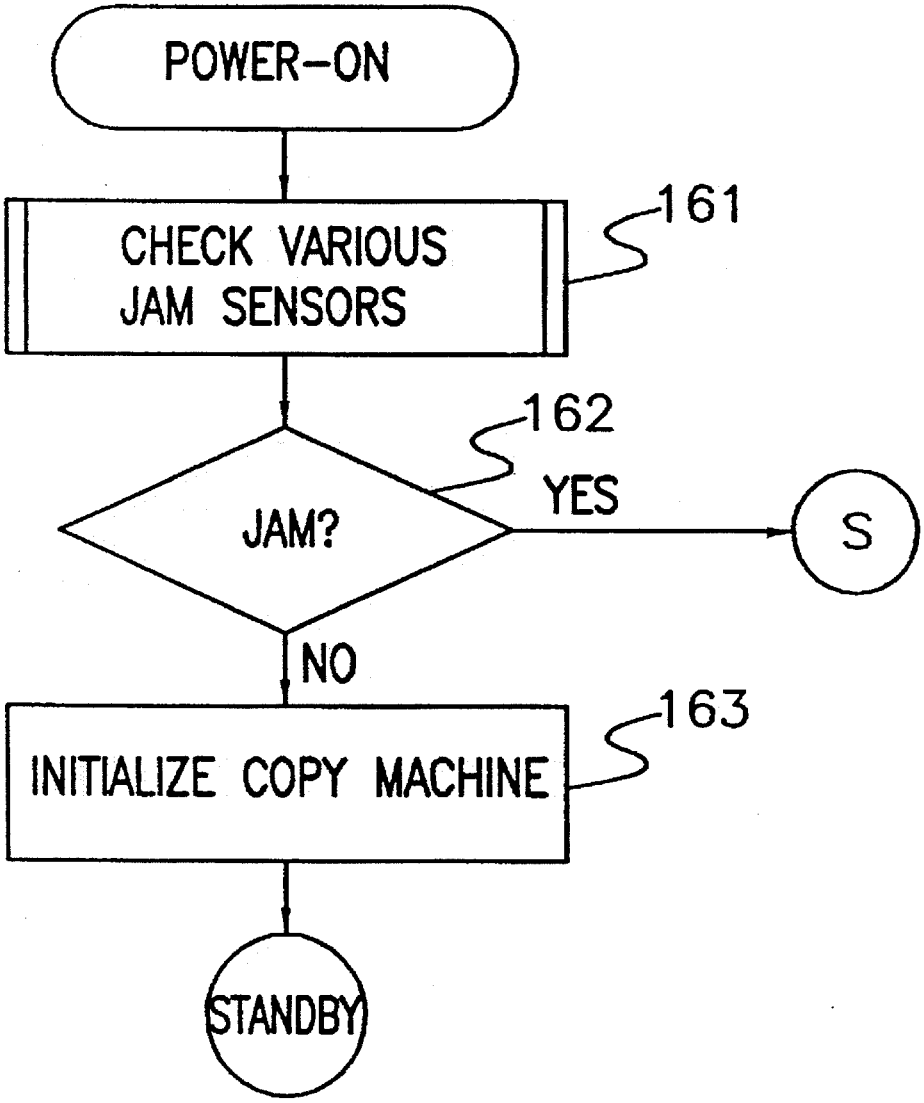
FIG. 6 is a flow chart illustrating a procedure of checking jam at a power-on state in accordance with the present invention.

FIG. 6 is a flow chart illustrating a procedure of checking jam at a power-on state in accordance with the present invention. Once the copy machine is powered on after the power is cut off accidentally or intentionally during the copying operation, various sensors are first checked (Step 161) to discriminate whether a jammed paper is present (Step 162). When the jammed paper is present, the procedure is returned to the first step of FIG. 3A so as to execute the above-mentioned procedures. Where a jam is generated when the copy machine is powered on after a temporal power-off during a normal operation thereof (a state that the fixture roller is kept sufficiently pre-heated), accordingly, it is removed immediately and automatically. This eliminates the inconvenience caused by the conventional unconditioned manual removal.

When a determination is made at the step 162 that there is no jammed paper, a normal copying standby state is immediately established to execute initialization of the copy machine (Step 163).

Therefore, the present invention enables the copy machine to automatically remove jam without requiring for the user to remove the jam manually. After removal of jam, a continued copying is also carried out without any additional manipulation in accordance with the present invention. Accordingly, it is possible to reduce the time taken to remove the jammed paper and provide a convenience in use of the copy machine. As a result, the use efficiency of the copy machine is enhanced.

Although the preferred embodiments of the invention have been disclosed for illustrative purposes, those skilled in the art will appreciate that various modifications, additions and substitutions are possible, without departing from the scope and spirit of the invention as disclosed in the accompanying claims.

What is claimed is:

1. A method for controlling an automatic discharge of a jammed paper to automatically remove a jam generated in a machine including a plurality of sensing means adapted to sense various operation conditions of the machine, central processing means adapted to analyze output signals from the sensing means and control overall operation of the machine on the basis of the analysis, means for supplying a power to various parts of the machine under a control of the central processing means, means for driving various parts of the machine under a control of the central processing means, and a manipulation panel coupled to the central processing means, the method comprising the steps of:

(A) discriminating a jam removal mode currently set when the jam is generated;

(B) checking kind of the generated jam where the current jam removal mode corresponds to an automatic or semi-automatic mode, incrementing, by one, a jam count indicative of the number of repeated jam removal operations in the current jam removal mode, determining whether the incremented jam count has reached a predetermined maximum jam removal number, manually removing the jam when the incremented jam count has reached the predetermined maximum jam removal number, while setting a jam removal try requiring flag and displaying the jam when the incremented jam count has not reached the predetermined maximum jam removal number;

(C) displaying a position of the jam, powering off a main driving part of the machine, and powering off predetermined parts of the machine for avoiding a generation of fire and a user from getting burnt upon manually removing the jam;

(D) checking whether the jam removal try requiring flag has been set, and checking kind of the jam when the jam removal try requiring flag has been set;

(E) checking whether a temperature of a fixture roller equipped in the machine has reached a fixture enable temperature where the jam generated corresponds to a body jam, determining whether the jam removal operation is to proceed, performing the jam removal operation on the basis of the just above determination, while proceeding to a subsequent step without performing any jam removal operation where the jam corresponds to a miss feed jam at a paper supply part of the machine to perform a copying operation;

(F) checking whether the jam removal mode set corresponds to the automatic removal mode or the semi-automatic removal mode, immediately performing the copying operation where the set jam removal mode corresponds to the automatic removal mode, while keeping a copying standby state and performing the copying operation when the user presses down a copying start key where the set jam removal mode corresponds to the semi-automatic removal mode;

(G) checking whether a jam has been generated after completion of the copying operation at the step (F), repeatedly executing all the above steps where the jam has been generated, while clearing associated counters and flags when a normal paper discharge has been accomplished, checking a copying mode currently set, repeatedly executing the copying operation performing step of the step (F) and the steps following the copying operation performing step where the set copying mode corresponds to a continuous copying mode, while repeatedly executing the copying standby step of the step (F) and the steps following the copying standby step where the set copying mode does not correspond to the continuous copying mode.

2. A method in accordance with claim 1, wherein the step (E) comprises the steps of:

(a) checking a current paper supply cassette position where the jam corresponds to the miss feed jam, and inhibiting a checking operation of a middle sensor for each front paper supply cassette stage of the machine; and (b) turning off a jam display to return the jam display to its normal state, and proceeding to the step (F).

3. A method in accordance with claim 1, wherein the step (E) comprises the steps of:

(a) incrementing a total jam count and a continuous jam count by one where the jam corresponds to the body jam;

(b) determining whether the temperature of the fixture roller has reached the fixture enable temperature, immediately jumping to the step for executing an operation in a manual removal mode when the temperature of the fixture roller has not reached the fixture enable temperature yet, while checking the jam removal mode currently set when the temperature of the fixture roller has reached the fixture enable temperature; and (c) performing a forced paper discharge where the set jam removal mode corresponds to the automatic removal mode, while keeping the copying standby state and performing the forced paper discharge when the user presses down the copying start key where the set jam removal mode corresponds to the semi-automatic removal mode while periodically checking the temperature of the fixture roller at the copying standby state and performing a transition of the jam removal mode to the manual removal mode just after the temperature of the fixture roller decreases below the fixture enable temperature.

4. A method in accordance with claim 3, wherein the forced paper discharge performed at the step (c) comprises the steps of:

calculating a drive time based on the distance between a paper supply position and a paper discharge sensor position and determining the calculated drive time as a maximum distance drive time;

calculating a drive time based on a size of the jammed paper and determining the just above drive time as a paper size time;

summing the maximum distance drive me and the paper size time and taking the resultant value as a maximum drive time, calculating a drive time based on the distance between a current jam position and a next jam check sensor just following the current position, and determining the just above drive time as a sensor time;

checking whether the currently jammed paper is positioned on a jam check sensor, determining the sensor time as a progress check time where the jammed paper is not positioned on the jam check sensor, while comparing the sensor time with the paper size time and determining the higher one of the compared times as the progress check time where the jammed paper is positioned on the jam check sensor;

checking whether a jam-in-process indicating flag has been set, incrementing a count for the maximum drive time and a count for the time elapsed from the point of time when the machine begins to drive where the jam-in-process indicating flag has been set, while turning on a feed clutch corresponding to the current paper supply position, a transfer/separation power pack and a charge/development power pack, setting a total counting inhibiting flag, and incrementing a count for a total drive time and a count for the drive time elapsed from the point of time when the machine begins to drive where the jam-in-process indicating flag has not been set;

comparing the total drive time with the maximum drive time, stopping the jam removal operation in the automatic removal mode and changing the jam removal mode to the manual removal mode where the total drive time is not less than the maximum drive time, while checking whether the jammed paper has reached the next jam check sensor where the total drive time is less than the maximum drive time, and proceeding to the step of calculating the sensor time when the jammed paper has reached the next jam check sensor;

comparing the drive time elapsed from the point of time when the machine begun to drive with the progress check time where the jammed paper has not reached the next jam check sensor yet, and returning to the first step (A) and repeatedly executing the first step (A) and the steps following the first step (A) where the drive time has reached the progress check time;

checking whether the jammed paper has been discharged, and repeatedly executing the step of incrementing the total drive time count and the drive time count and the steps following the incrementing Step where the jammed paper has not been discharged, until the jammed paper is completely discharged; and clearing the total counting inhibiting flag and various associated flags after the jammed paper is completely discharged, resetting a body jam counter, turning off displays on the manipulation panel associated with the jam to be normally on standby, and checking the jam removal mode currently set.

5. A method in accordance with claim 4, wherein the forced paper discharge performed at the step (c) further comprises the step of:

checking a mode change reference count, the continuous jam count and the total jam count just after the completion of the discharge of jammed paper has been confirmed, and automatically changing the jam removal mode from the automatic removal mode to the semi-automatic removal mode when the number of jams generated during the copying operation for a predetermined period is not less than a predetermined reference jam generation rate, while automatically changing the jam removal mode from the semi-automatic removal mode to the automatic removal mode when the number of jams generated is less than the predetermined reference jam generation rate.

6. A method in accordance with claim 5, wherein the steps of automatically changing the jam removal mode comprise the steps of:

checking whether the mode change reference count indicative of the number of repeated copying operations has reached a predetermined reference number of jams for a mode change;

determining whether the continuous jam count has reached the predetermined mode change reference jam number where the mode change reference count has not reached the predetermined mode change reference jam number, and proceeding to the jam removal mode checking step of the step (F) where the continuous jam count is less than the predetermined mode change reference jam number, while checking the current jam removal mode where the continuous jam count is not less than the predetermined mode change reference jam number and automatically changing the jam removal mode to the semi-automatic removal mode where the jam removal mode corresponds to the automatic removal mode;

determining whether the total jam count has reached the predetermined mode change reference jam number where the mode change reference count has reached the predetermined mode change reference jam number, and checking the current jam removal mode where the total jam count is not less than the predetermined mode change reference jam number and automatically changing the jam removal mode to the semi-automatic removal mode where the jam removal mode corresponds to the automatic removal mode, while checking the current jam removal mode where the total jam count is less than the predetermined mode change reference jam number and automatically changing the jam removal mode to the automatic removal mode where the jam removal mode corresponds to the semi-automatic removal mode; and clearing a mode change reference counter, the total jam counter and the continuous jam counter, and proceeding to the step (F) of checking the current jam removal mode.

7. A method in accordance with claim 1, further comprising the step of:

(H) changing, when the user presses down a mode change key to require a mode change, the current jam removal mode to the semi-automatic jam removal mode where the current jam removal mode corresponds to the automatic removal mode, to the manual removal mode where the current jam removal mode corresponds to the semi-automatic removal mode and to the automatic removal mode where the current jam removal mode corresponds to the manual removal mode, and turning on a light emitting diode corresponding to the current jam removal mode, thereby achieving a manual mode change.

8. A method in accordance with claim 1, further comprising the step of:

(I) checking various sensors upon powering-on of the machine to discriminate whether a jammed paper is present in the machine, and returning to the step (A) when the jammed paper is present, thereby immediately achieving the automatic jam removal at a state that the fixture roller is kept sufficiently pre-heated, while immediately establishing a copying standby state when no jammed paper is present.

9. A method for controlling an automatic discharge of a jammed paper to automatically remove a jam generated in a machine including a plurality of sensing means adapted to sense various operation conditions of the machine, central processing means adapted to analyze output signals from the sensing means and control overall operation of the machine on the basis of the analysis, means for supplying a power to various parts of the machine under a control of the central processing means, means for driving various parts of the machine under a control of the central processing means, a manipulation panel coupled to the central processing means, and sorter control means coupled to the central processing means, the method comprising the steps of:

(A) discriminating a jam removal mode currently set when the jam is generated;

(B) checking kind of the generated jam where the current jam removal mode corresponds to an automatic or semi-automatic mode, incrementing, by one, a jam count indicative of the number of repeated jam removal operations in the current jam removal mode, determining whether the incremented jam count has reached a predetermined maximum jam removal number, manually removing the jam when the incremented jam count has reached the predetermined maximum jam removal number, while setting a jam removal try requiring flag and displaying the jam when the incremented jam count has not reached the predetermined maximum jam removal number;

(C) displaying a position of the jam, powering off a main driving part of the machine, and powering off predetermined parts of the machine for avoiding a generation of fire and a user from getting burnt upon manually removing the jam;

(D) checking whether the jam removal try requiring flag has been set, and checking kind of the jam when the jam removal try requiring flag has been set;

(E) checking whether the jam generated corresponds to a miss feed jam at a paper supply part of the machine or a body jam, checking whether a temperature of a fixture roller equipped in the machine has reached a fixture enable temperature where the generated jam corresponds to the body jam, checking a jam removal mode currently set, checking whether a sorter equipped in the machine is at its opened state, and then performing a forced jam removal operation, while proceeding to a subsequent step without performing any jam removal operation where the jam corresponds to the miss feed jam to perform a copying operation;

(F) checking whether the jam removal mode set corresponds to the automatic removal mode or the semi-automatic removal mode, immediately performing the copying operation where the set jam removal mode corresponds to the automatic removal mode, while keeping a copying standby state and performing the copying operation when the user presses down a copying start key where the set jam removal mode corresponds to the semi-automatic removal mode;

(G) checking whether a jam has been generated after completion of the copying operation at the step (F), repeatedly executing all the above steps where the jam has been generated, while clearing associated counters and flags when a normal paper discharge has been accomplished, checking a copying mode currently set, repeatedly executing the copying operation performing step of the step (F) and the steps following the copying operation performing step where the set copying mode corresponds to a continuous copying mode, while repeatedly executing the copying standby step of the step (F) and the steps following the copying standby step where the set copying mode does not correspond to the continuous copying mode.

10. A method in accordance with claim 9, wherein the step (E) comprises the steps of:

(a) checking a current paper supply cassette position where the jam corresponds to the miss feed jam, and inhibiting a checking operation of a middle sensor for each front paper supply cassette stage of the machine; and (b) turning off a jam display to return the jam display to its normal state, and proceeding to the step (F).

11. A method in accordance with claim 10, wherein the step (E) comprises the steps of:

(a) incrementing a total jam count and a continuous jam count by one where the jam corresponds to the body jam;

(b) determining whether the temperature of the fixture roller has reached the fixture enable temperature, immediately jumping to the step for executing an operation in a manual removal mode when the temperature of the fixture roller has not reached the fixture enable temperature yet, while checking the jam removal mode currently set when the temperature of the fixture roller has reached the fixture enable temperature, and proceeding to a subsequent step where the set jam removal mode corresponds to the automatic removal mode, while keeping the copying standby state and proceeding to the subsequent step when the user presses down the copying start key where the set jam removal mode corresponds to the semi-automatic removal mode while periodically checking the temperature of the fixture roller at the copying standby state and performing a transition of the jam removal mode to the manual removal mode just after the temperature of the fixture roller decreases below the fixture enable temperature; and (c) checking whether the sorter is at its opened state, and proceeding to the step (a) when the sorter is at its opened state, while performing a forced jam removal operation when the sorter is at its closed state.

12. A method in accordance with claim 11, wherein the forced paper discharge performed at the step (c) comprises the steps of:

calculating a drive time based on the distance between a paper supply position and a paper discharge sensor position and a time taken for a paper to pass through the sorter and determining a maximum distance drive time, based on the calculated times;

calculating a drive time based on a size of the jammed paper and determining the just above drive time as a paper size time;

summing the maximum distance drive time and the paper size time and taking the resultant value as a maximum drive time, calculating a drive time based on the distance between a current jam position and a next jam check sensor just following the current position, and determining the just above drive time as a sensor time;

checking whether the currently jammed paper is positioned on a jam check sensor, determining the sensor time as a progress check time where the jammed paper is not positioned on the jam check sensor, while comparing the sensor time with the paper size time and determining the higher one of the compared times as the progress check time where the jammed paper is positioned on the jam check sensor;

checking whether a jam-in-process indicating flag has been set, incrementing a count for the maximum drive time and a count for the time elapsed from the point of time when the machine begins to drive where the jam-in-process indicating flag has been set, while turning on a feed clutch corresponding to the current paper supply position, a transfer/separation power pack and a charge/development power pack, setting a total counting inhibiting flag, and incrementing a count for a total drive time and a count for the drive time elapsed from the point of time when the machine begins to drive where the jam-in-process indicating flag has not been set;

comparing the total drive time with the maximum drive time, stopping the jam removal operation in the automatic removal mode and changing the jam removal mode to the manual removal mode where the total drive time is not less than the maximum drive time, while checking whether the jammed paper has reached the next jam check sensor where the total drive time is less than the maximum drive time, and proceeding to the step of calculating the sensor time when the jammed paper has reached the next jam check sensor;

comparing the drive time elapsed from the point of time when the machine begun to drive with the progress check time where the jammed paper has not reached the next jam check sensor yet, and returning to the first step (A) and repeatedly executing the first step (A) and the steps following the first step (A) where the drive time has reached the progress check time;

checking whether the jammed paper has been discharged, and repeatedly executing the step of incrementing the total drive time count and the drive time count and the steps following the incrementing step where the jammed paper has not been discharged, until the jammed paper is completely discharged; and clearing the total counting inhibiting flag and various associated flags after the jammed paper is completely discharged, resetting a body jam counter, turning off displays on the manipulation panel associated with the jam to be normally on standby, and checking the jam removal mode currently set.

13. A method in accordance with claim 12, wherein the forced paper discharge performed at the step (c) further comprises the step of:

checking a mode change reference count, the continuous jam count and the total jam count just after the completion of the discharge of jammed paper has been confirmed, and automatically changing the jam removal mode from the automatic removal mode to the semi-automatic removal mode when the number of jams generated during the copying operation for a predetermined period is not less than a predetermined reference jam generation rate, while automatically changing the jam removal mode from the semi-automatic removal mode to the automatic removal mode when the number of jams generated is less than the predetermined reference jam generation rate.

14. A method in accordance with claim 13, wherein the steps of automatically changing the jam removal mode comprise the steps of:

checking whether the mode change reference count indicative of the number of repeated copying operations has reached a predetermined reference number of jams for a mode change;

determining whether the continuous jam count has reached the predetermined mode change reference jam number where the mode change reference count has not reached the predetermined mode change reference jam number, and proceeding to the copying standby step of the step (F) where the continuous jam count is less than the predetermined mode change reference jam number, while checking the current jam removal mode where the continuous jam count is not less than the predetermined mode change reference jam number and automatically changing the jam removal mode to the semi-automatic removal mode where the jam removal mode corresponds to the automatic removal mode;

determining whether the total jam count has reached the predetermined mode change reference jam number where the mode change reference count has reached the predetermined mode change reference jam number, and checking the current jam removal mode where the total jam count is not less than the predetermined mode change reference jam number and automatically changing the jam removal mode to the semi-automatic removal mode where the jam removal mode corresponds to the automatic removal mode, while checking the current jam removal mode where the total jam count is less than the predetermined mode change reference jam number and automatically changing the jam removal mode to the automatic removal mode where the jam removal mode corresponds to the semi-automatic removal mode; and clearing a mode change reference counter, the total jam counter and the continuous jam counter, and proceeding to the step (F) of checking the current jam removal mode.

15. A method in accordance with claim 9, further comprising the step of:

(H) changing, when the user presses down a mode change key to require a mode change, the current jam removal mode to the semi-automatic jam removal mode where the current jam removal mode corresponds to the automatic removal mode, to the manual removal mode where the current jam removal mode corresponds to the semi-automatic removal mode and to the automatic removal mode where the current jam removal mode corresponds to the manual removal mode, and turning on a light emitting diode corresponding to the current jam removal mode, thereby achieving a manual mode change.

16. A method in accordance with claim 9, further comprising the step of:

(I) checking various sensors upon powering-on of the machine to discriminate whether a jammed paper is present in the machine, and returning to the step (A) when the jammed paper is present, thereby immediately achieving the automatic jam removal at a state that the fixture roller is kept sufficiently pre-heated, while immediately establishing a copying standby state when no jammed paper is present.

* * * * *